US005406360A

United States Patent [19]

Asai

[11] Patent Number: 5,406,360

[45] Date of Patent: Apr. 11, 1995

[54] IMAGE FORMING APPARATUS WITH CONTACT TRANSFER MEMBER

[75] Inventor: Jun Asai, Tokyo, Japan

[73] Assignee: Canon Kabushiki Kaisha, Tokyo, Japan

[21] Appl. No.: 91,200

[22] Filed: Jul. 14, 1993

[30] Foreign Application Priority Data

Jul. 16, 1992 [JP] Japan ..... 4-212158

[51] Int. Cl.[6] ..... G03G 15/00

[52] U.S. Cl. ..... 355/274; 355/277

[58] Field of Search ..... 355/271, 274, 277, 278, 355/279, 280, 281

[56] References Cited

U.S. PATENT DOCUMENTS

| | | | |
|---|---|---|---|
| 4,380,385 | 4/1983 | Ozaki et al. | 355/277 |
| 4,719,489 | 1/1988 | Ohkubo et al. | 355/290 |
| 4,910,558 | 3/1990 | Giezeman et al. | 355/279 |
| 5,038,178 | 8/1991 | Hosoya et al. | 355/277 |
| 5,159,393 | 10/1992 | Hiroshima et al. | 355/277 |
| 5,172,172 | 12/1992 | Amemiya et al. | 355/271 |
| 5,182,604 | 1/1993 | Asai | 355/273 |
| 5,233,395 | 8/1993 | Kohyama | 355/274 |

FOREIGN PATENT DOCUMENTS

| | | | |
|---|---|---|---|
| 0073071 | 6/1980 | Japan | 355/274 |
| 0247378 | 10/1987 | Japan | 355/274 |
| 0177063 | 7/1989 | Japan | 355/280 |
| 0013170 | 1/1992 | Japan | 355/277 |

*Primary Examiner*—Robert B. Beatty

*Attorney, Agent, or Firm*—Fitzpatrick, Cella, Harper & Scinto

[57] ABSTRACT

The present invention provides an image forming apparatus with an image bearing member, an image forming device for forming a toner image on the image bearing member, and a transfer device adapted to transfer the toner image onto a transfer material at a transfer station and capable of contacting with a surface of the transfer material opposite to the image bearing member. A combined pressure force of the transfer material and transfer device against the image bearing member during a transferring operation is selected to be 0.2–8 grams per 1 cm in a longitudinal direction of the transfer device.

15 Claims, 8 Drawing Sheets

IMAGE FORMING APPARATUS WITH CONTACT TRANSFER MEMBER

BACKGROUND OF THE INVENTION

1. Field of the Invention

The present invention relates to an image forming apparatus such as an electrostatic copying machine, electrostatic printer and the like, wherein an image is obtained on a transfer material by utilizing an electrostatic transfer process.

2. Related Background Art

In the past, it is known to provide an image forming apparatus in which a transfer means such as a transfer roller of contact type is pressed against a moving image bearing member and, when a transfer material is passed through the nip (transfer station), a toner image formed on the image bearing member is overlapped with the transfer material and the toner image is transferred onto the transfer material by applying a transfer bias having the polarity opposite to that of the toner to the transfer means, thereby forming the image on the transfer material.

Such conventional image forming apparatus has advantages that a power source for the transfer bias can be simplified, that the transfer discrepancy is hard to occur and that no ozone or minimum ozone is generated. To the contrary, since the toner image is urged against the image bearing member at the transfer station, if the adhesion force of the toner image to the image bearing member is stronger than an electrostatic force of the transfer electric field due to the aggregation between the toner particles and the attraction between the toner and the image bearing member, the toner image cannot be transferred onto the transfer material properly, thereby causing a so-called "void" wherein a portion of the image is missing.

In order to avoid this, (1) in the image forming apparatus using the transfer means of contact type, an amount of additive such as silica for the toner was increased, thereby reducing the aggregation force between the toner particles and the attraction force between the toner and the image bearing member.

(2) In an image forming apparatus using a transfer roller as the transfer means, the hardness of the transfer roller was decreased as much as possible, thereby reducing the urging force of the toner against the image bearing member.

(3) A shifting speed of the transfer material was differentiated from a moving speed of the image bearing member, thereby preventing the occurrence of the void in the image.

(4) In an image forming apparatus using a transfer drum as the transfer means, an urging force against the image bearing member was reduced.

However, even in the above trials, the void in the image could not be prevented completely for the following reasons.

In the above case (1) (increasing the amount of the additive), since the fog occurs, the fixing ability is worsened and the density is decreased under the high humidity condition when the apparatus is left as it is for a long time, the increase of the additive is limited.

In the above case (2) (decreasing the hardness of the transfer roller), since the selection of the material of the transfer roller is limited and the transfer roller must have an inherently high hardness by adding and dispersing the conductive agent to obtain the desired range of electric resistance required for the transferring operation, if the hardness is decreased, adequate electric resistance cannot be expected.

In the above case (3) (differentiating the shifting speed of the transfer material from the moving speed of the image bearing member), the elongation and contraction of the image will occur, and, in order to correct this, the latent image must be elongated or contracted, which results in the deterioration of the resolving power particularly in the analogue copying machines. Further, during the transferring operation, the transfer discrepancy and/or scattering of the image will occur, and the toner and its additive are adhered and fused to the image bearing member, thereby generating the black stripes (so-called "fusion" "filming") in the image. This trial is disadvantageous also in the point that such black stripes should be prevented.

In the above case (4), even when the urging force of the transfer drum against the image bearing member is decreased, if the transfer material has high rigidity, since there arises an urging force against the image bearing member due to the rigidity of the transfer material itself, the void cannot be prevented.

SUMMARY OF THE INVENTION

An object of the present invention is to provide an image forming apparatus wherein the voids can be prevented during the transferring operation.

Another object of the present invention is to provide an image forming apparatus which can prevent the adhesion and fusion of toner to an image bearing member.

A further object of the present invention is to provide an image forming apparatus which can obtain a good image.

The other objects and features of the present invention will be apparent from the following description referring to the accompanying drawings.

DETAILED DESCRIPTION OF THE PREFERRED EMBODIMENT

First Embodiment

Figure 1:
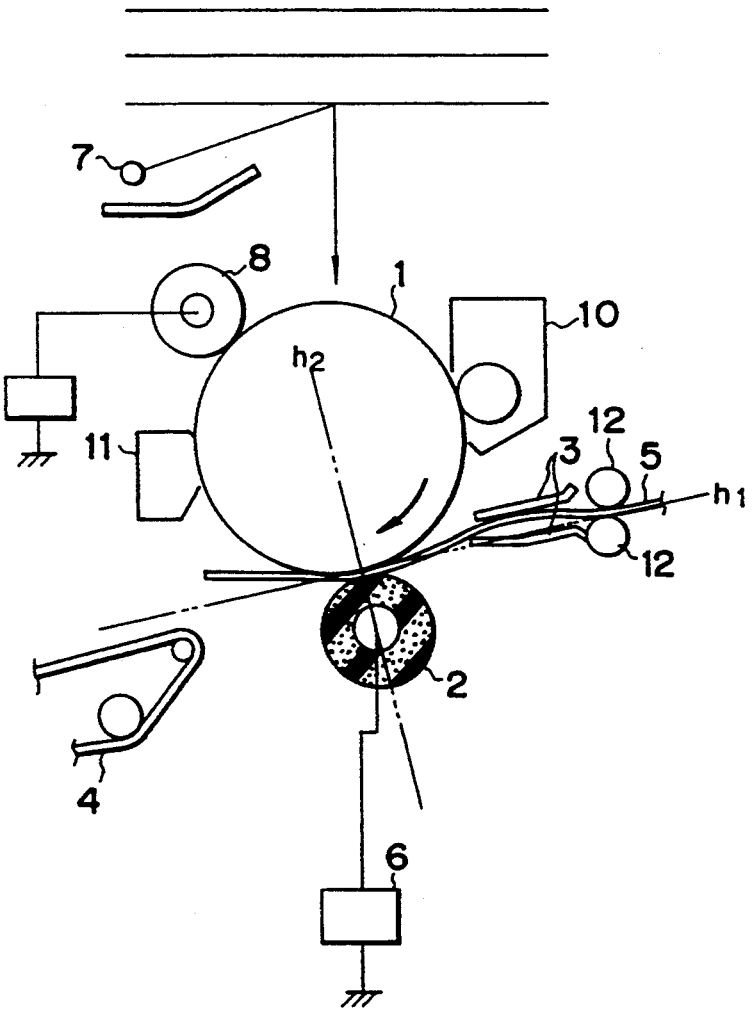
FIG. 1 is a schematic constructural view of an image forming apparatus according to a preferred embodiment of the present invention.

FIG. 1 is a schematic constructural view of an image forming apparatus according to a first embodiment of the present invention.

In FIG. 1, a transfer roller (transfer means) 2 having an axis parallel with a photosensitive drum (image bearing member) 1 is pressed against the photosensitive drum so that a nip between the transfer roller and the photosensitive drum forms a transfer station.

Around the photosensitive drum 1, there are arranged a primary charger roller 8, a light source 7, a developing device 10, a cleaner 11 and other members for forming an image. After the residual toner remaining on the photosensitive drum 1 is removed by the cleaner 11, the photosensitive drum 1 is uniformly charged with a predetermined voltage by the primary charger roller 8 and then is exposed by image light from the light source, thereby forming an electrostatic latent image on the photosensitive drum 1. The latent image is developed by the developing device 10 to form a toner image as the photosensitive drum 1 is rotated to bring the latent image to a developing station. As the photosensitive drum 1 is further rotated, the toner image is sent to the transfer station where the transfer roller is pressed against the photosensitive drum.

The transfer roller 2 is connected to a transfer bias power source 6 which can be controlled to maintain the constant current and constant voltage, so that a constant-current controlled transfer bias is applied to the transfer roller 2 before the toner image formed on the photosensitive drum 1 reaches the transfer station. Thereafter, at the same time when a transfer material reaches the transfer station, a constant-voltage controlled transfer bias having the constant voltage is applied to the transfer roller 2 from the power source 6 on the basis of the voltage generated on the transfer roller at the constant current control, so that a transfer electric field is created between the photosensitive drum 1 and the transfer material, thereby transferring the toner image formed on the photosensitive drum 1 onto the transfer sheet.

In the illustrated embodiment, the constant voltage applied to the transfer roller 2 is 2–7 KV (absolute value), the volume specific resistance of the transfer roller is in the order of $10^6$–$10^{12}$ Ω.cm (calculated from the resistance value between a surface of the transfer roller and a metal core), and the density of charge supplied to the image portion by the transfer roller 2 is in the order of $10^{-8}$–$10^{-10}$ C/cm$^2$ (calculated from the current during the conveyance of the transfer material).

The developer to be used may be one-component magnetic developer comprised of magnetic toner, one-component non-magnetic developer comprised of non-magnetic toner or two-component developer comprised of non-magnetic toner and magnetic carrier, and preferably comprises toner having polyester resin group or styrene acrylic resin group as main resin and having an average particle diameter of 4–12 μm. Silica of about 4–1.2 wt % is added to the toner.

A toner weight (per unit area) and a toner charge amount (per unit weight of toner) of a black image (whole surface toner image) formed on the photosensitive drum 1 are 5–15 mg/cm$^2$ and 2–50 μC/g, respectively.

The transfer material to which the toner image was transferred is separated from the photosensitive drum and then is sent, through a convey portion 4, to a fixing station (not shown), where the toner image is fixed to the transfer material.

In the image forming apparatus according to the illustrated embodiment, it is possible to feed the maximum A4 size transfer material in a longitudinal direction (corresponding to a conveying direction of the transfer material) to form the image on the transfer material, and lengths of the photosensitive drum 1 and the transfer roller 2 in the longitudinal direction (substantial perpendicular to the plane of FIG. 1) are about 230–250 mm. In this apparatus, the available transfer material having the greatest rigidity is a post card.

A photosensitive layer of the photosensitive drum 1 is formed from OPC, selenium, amorphous Si or the like, and a diameter of the photosensitive drum 1 is about 20–200 mm. The transfer roller 2 is formed from urethane rubber foam and has a diameter of 5–50 mm. A diameter of the metal core is 2–30 mm and the hardness of the transfer roller is in the order of 20–40° (Asker C) with a load of 300 grams. In place of urethane rubber foam, the transfer roller 2 may be constituted by coating urethane or fluororesin on a foam surface layer. In the illustrated embodiment, a surface moving speed of the photosensitive drum 1 is about 30–500 mm/sec, and a surface moving speed of the transfer roller 2 at the transfer station may be equal to the moving speed of the photosensitive drum or may be differentiated from the moving speed of the photosensitive drum by 0.1–5%.

Figure 2:
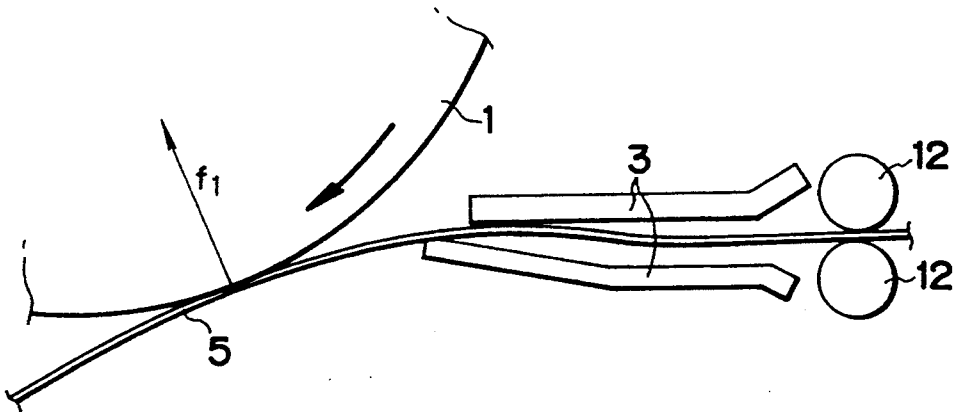
FIG. 2 is an enlarged view for explaining an abut force of a transfer material due to its rigidity against a photosensitive drum in the image forming apparatus of FIG. 1.

As shown in FIG. 2, at an upstream side of the photosensitive drum at the transfer station, there are arranged a pair of register rollers 12 and a transfer guide 3 for feeding the transfer material 5 to the transfer station, so that a feeding path of the transfer material 5 to the transfer station is defined by the register rollers 12, transfer guide 3 and photosensitive drum 1. The transfer guide 3 is formed from metal such as SUS, aluminium or the like, or elastic body or rigid body such as PET, ABS, PTFE or the like.

Even when the transfer material 5 is not forcibly urged against the photosensitive drum 1 by the transfer roller 2, it is urged against the photosensitive drum at the transfer station with a force $f_1$ directing to the center of the photosensitive drum 1 due to the rigidity of the transfer material itself. The pressure force $f_1$ of the transfer material is determined by a thickness and Young's modulus of the transfer material, except for leading and trailing ends of the transfer material. Thus, the greater the rigidity of the transfer material 5 the stronger the pressure force $f_1$.

The actual measurement of the pressure force $f_1$ can be effected by arranging a dummy photosensitive drum at a position of the photosensitive drum 1 and by measuring the pressure force of the transfer material 5 against the dummy drum by means of a piezo-electric sensor. Incidentally, when the pressure force is measured while rotating the dummy drum at a speed same as that of the photosensitive drum 1, the change in the pressure force of the transfer material being fed through the transfer station can be known.

Figure 3:
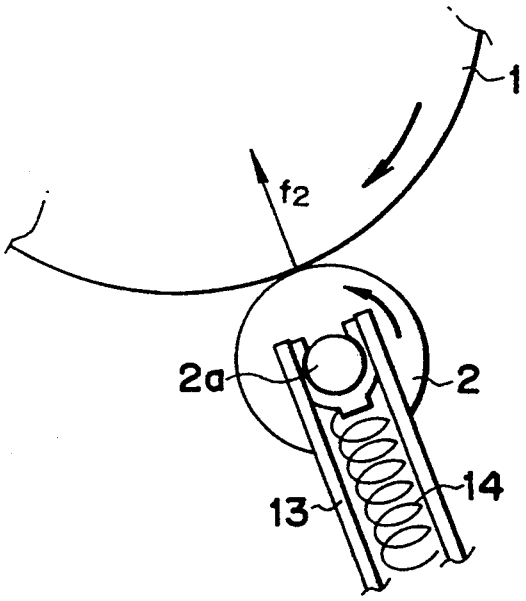
FIG. 3 is an enlarged view for explaining a pressure force of a transfer roller against the photosensitive drum.

As shown in FIG. 3, the transfer roller 2 is biased toward the center of the photosensitive drum 1 by pushing a rotary shaft 2a of the transfer roller toward the photosensitive drum by a pressure spring 14 contained in a cylindrical support member 13, so that a pressure force $f_2$ is generated between the transfer roller and the photosensitive drum 1. The pressure force $f_2$ of the transfer roller 2 is substantially constant, regardless of the presence or absence of the transfer material 5 between the photosensitive drum 1 and the transfer roller, with the result that the pressure force $f_2$ of the transfer roller 2 can be considered as a pressure force of the transfer material 5 urged against the photosensitive drum by the transfer roller 2.

According to the illustrated embodiment, the pressure force $f_2$ of the transfer roller 2 is about 0.1–5 grams (per 1 cm) in the longitudinal direction (axial direction). The actual measurement of the abut pressure $f_2$ of the transfer material urged against the photosensitive drum by the transfer roller 2 can be effected in the same manner as the measurement of the pressure force $f_1$ by using a dummy photosensitive drum.

When the toner image is transferred, i.e., when the transfer material exists in the transfer station, a force of the transfer material urging the photosensitive drum becomes $f_1$ (FIG. 2)$+f_2$ (FIG. 3). Regarding a post card used as the transfer material, FIG. 4 shows a relation between the total pressure force ($f_1+f_2$) and the void level when the position of the transfer guide 3 is fixed (the pressure force $f_1$ due to the rigidity of the transfer material is constant) and the pressure force of the transfer roller 2 is varied and when the pressure spring 14 is fixed, i.e., the pressure force of the transfer roller 2 is fixed (the pressure force $f_2$ of the transfer roller 2 is constant) and the position of the transfer guide 3 is varied.

The condition of the image formation was as follows. That is to say, the photosensitive drum 1 was an OPC drum capable of being charged negatively and having a diameter of 30 mm, the developer was magnetic toner of polyester group capable of being charged positively and having an average particle diameter of 8 μm, and the additive was solica of 0.6 wt %. Further, the process speed was 50 mm/sec, a diameter of the transfer roller 2 was 20 mm, the transfer guide 3 was made from SUS having a thickness of 1.0 mm, and a distance between the photosensitive drum 1 and the leading end of the transfer guide 3 was about 8 mm.

Figure 4:
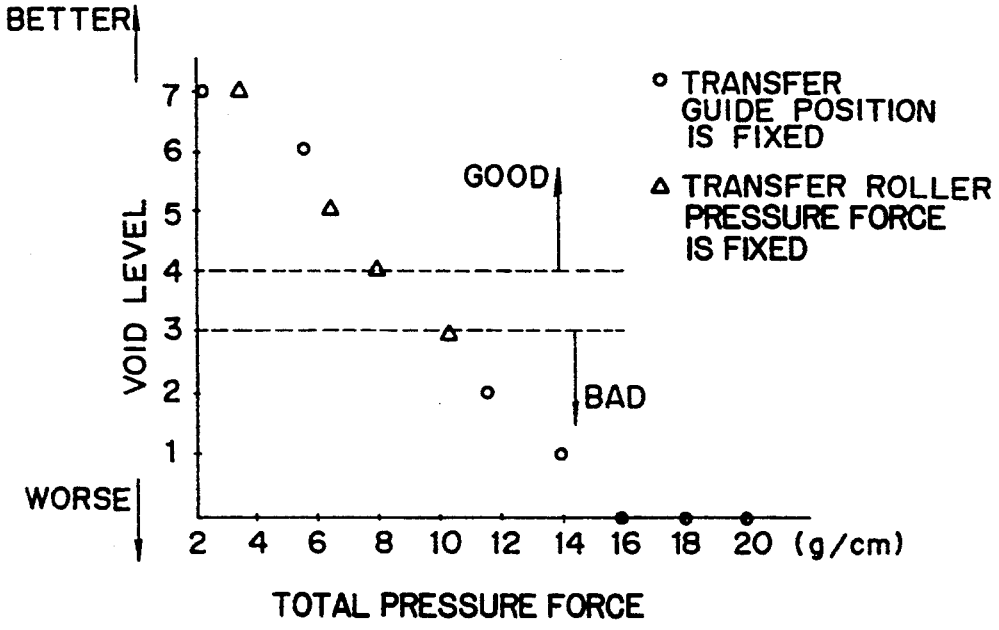
FIG. 4 is an explanatory view showing a relation between a resultant pressure force obtained from the pressure force of the rigidity of the transfer material and the transfer roller, and a level of a void generated during the transferring operation in this case.

As shown in FIG. 4, in order to achieve the void level 4 regarding the image transferred to the post card, the total pressure force obtained by combining the pressure force of the rigidity of the transfer material and the pressure force of the transfer roller 2 was desirable to be 8 grams or less per 1 cm in the longitudinal direction of the transfer roller 2, and more preferably, was 4 grams or less per 1 cm in the longitudinal direction.

As a result of tests effected by varying the surface features of the transfer materials and the relative speeds between the transfer material and the photosensitive drum, it was found that the relation between the total pressure force and the void level as shown in FIG. 4 could be similarly obtained regarding the transfer materials having different surface features, and the total pressure force was desirably about 8 grams per 1 cm in the longitudinal direction of the transfer roller 2 and more particularly 4 grams or less per 1 cm in the longitudinal direction.

The following Table 1 shows the pressure force of the rigidity of the transfer material, pressure force of the transfer means (transfer roller) and total pressure force regarding various transfer materials in the illustrated embodiment.

TABLE 1

| Kind of transfer material | Pressure force of rigidity (g/cm) | Pressure force of transfer means (g/cm) | Total pressure force (g/cm) |
|---|---|---|---|
| 52 g/m$^2$ paper | 0.6 | 1.5 | 2.1 |
| 64 g/m$^2$ paper | 1.3 | 1.5 | 2.8 |
| OHP sheet (transparent resin film) | 2.3 | 1.5 | 3.8 |
| Post card | 5.5 | 1.5 | 7.0 |
| 128 g/m$^2$ paper | 3.3 | 1.5 | 4.8 |

As shown in Table 1, in the illustrated embodiment, since the total pressure force of the post card having the maximum total abut force is 7.0 g/cm, there is no void even in the post card.

In the conventional transfer means of contact type, although it was considered that if the width of the nip or transfer station was narrow the transfer irregularity and/or the reduction of the transfer efficiency arose, it was found that, when the total pressure force obtained by combining the pressure force of the rigidity of the transfer material and the pressure force of the transfer roller was 0.2 g/cm or more, the reduction of the transfer efficiency and the transfer irregularity did not occur even if the contact between the transfer material and the photosensitive drum was poor due to the bending of the transfer material and/or wrinkles in the transfer material.

The reason is that, since the transfer charge is applied at the contact portion between the transfer material and the transfer roller and the discharge occurs at the contact portion and non-contact portion between the photosensitive drum and the transfer material when the transfer material is wetted to a certain extent and since the charge is applied at the contact portion between the transfer material and the transfer roller and the discharge occurs at the contact portions and non-contact portions between the transfer material and the transfer roller and between the transfer material and the photosensitive drum when the transfer material is dried, even if there is the poor contact more or less, the transfer electric field can act.

Figure 5:
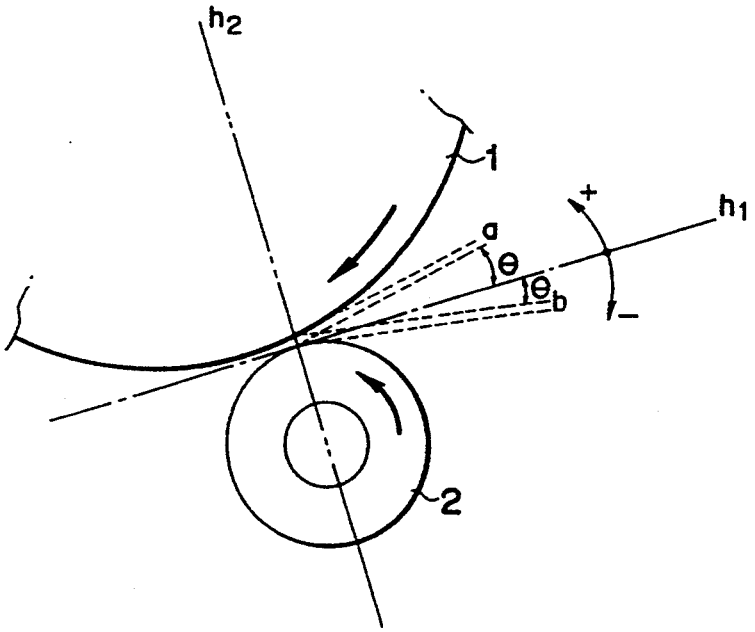
FIG. 5 is an enlarged view for explaining positions of the transfer material in the proximity of a transfer station.

When the pressure force of the transfer means of contact type (such as the transfer roller) is reduced, the position of the transfer material in the proximity of the transfer station where the transfer means is pressed against the photosensitive drum will effect the occurrence and non-occurrence of the scattering of the image. FIG. 5 shows the positions of the transfer materials in the proximity of the transfer station during the transferring operation. In FIG. 5, $h_2$ shows a line connecting between centers of the transfer roller 2 and of the photosensitive drum 1, and $h_1$ shows a line tangential to the photosensitive drum 1 at the transfer station and perpendicular to the line $h_2$. Broken lines a and b show the positions of the transfer materials during the transferring operation. Particularly, the transfer material shown by the broken lines a is sent to the transfer station from above the tangential line $h_1$ (toward the photosensitive drum 1), whereas, the transfer material shown by the broken lines b is sent to the transfer station from below the tangential line $h_1$ (toward the transfer roller 2).

Figure 6:
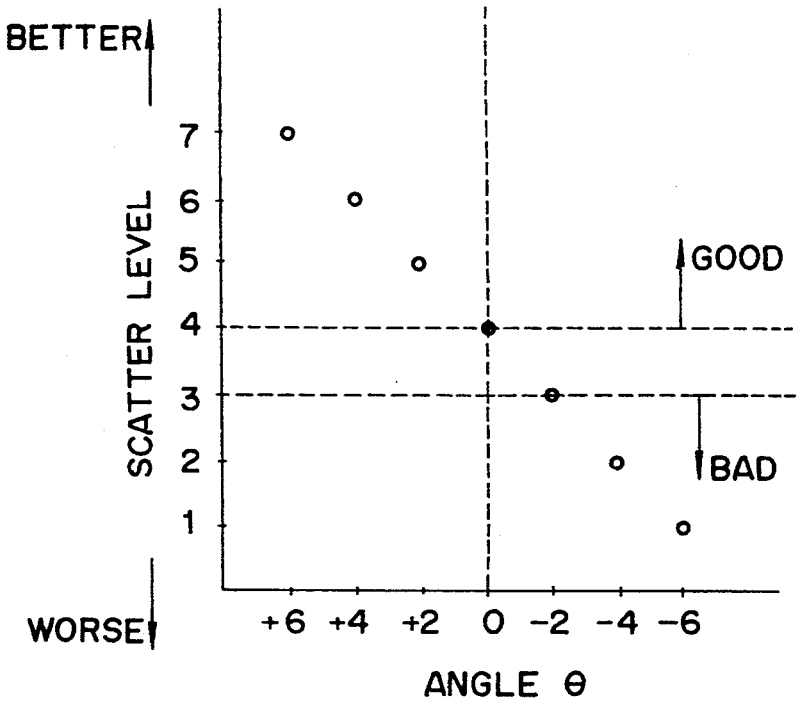
FIG. 6 is an explanatory view showing a relation between an angle $\theta$ between the transfer material and a tangential line $h_1$ of the photosensitive drum at an upstream side of the transfer station, and the scatter level of the image generated during the transferring operation in this case.

FIG. 6 shows a relation between an angle $\theta$ between the tangential line $h_1$ and the transfer material at an upstream side of the transfer station in the shifting direction of the transfer material, and a scatter level of toner around the image transferred in this case. In FIG. 6, the sign "+" in the value $\theta$ (abscissa) shows the fact that the transfer material is offset toward the photosensitive drum 1 from the tangential line $h_1$, and the sign "−" in the value $\theta$ shows the fact that the transfer material is offset toward the transfer roller 2 from the tangential line. As is apparent from FIG. 6, the scattering of the image becomes good as the transfer material 5 is positioned near the photosensitive drum 1 as long as possible during the transferring operation, and becomes bad as the transfer material is positioned near the transfer roller 2. The reason is that the transfer electric field acts at the upstream side of the transfer station.

When the pressure force of the transfer roller 2 is great, the angle $\theta$ often becomes zero or therearound, so that there was the limitation in the improvement in the scattering of the image. Although the scattering of the image varies in accordance with the thickness of the transfer material, degree of dryness of the transfer material, kind of the transfer material, transfer electric field, diameter of the transfer roller, diameter of the photosensitive drum, charging amount of toner and other factors, in general, when the angle $\theta$ is offset toward the photosensitive drum from 0°, the degree of the scattering can be permitted.

Similarly, since an angle ($\theta'$) between the tangential line $h_1$ and the transfer material at a downstream side of the transfer station in the shifting direction of the transfer material affects an influence upon the scattering of image at the trailing end portion of the transfer material particularly when the rigidity of the transfer material is great, it is important that any members contacting with the transfer material (such as convey belt, fixing device, convey rib and the like) are not arranged at the side of the photosensitive drum 1 with respect to the tangential line $h_1$ in order to prevent the angle value $\theta$ from becoming zero or minus. In addition to the "scattering", the poor transfer due to the "tailing" and the abnormal discharge is effected by the angle $\theta$, and such phenomenon does not occur when the angles $\theta$, $\theta'$ are plus (the transfer material is positioned toward the photosensitive drum).

Figure 7A:
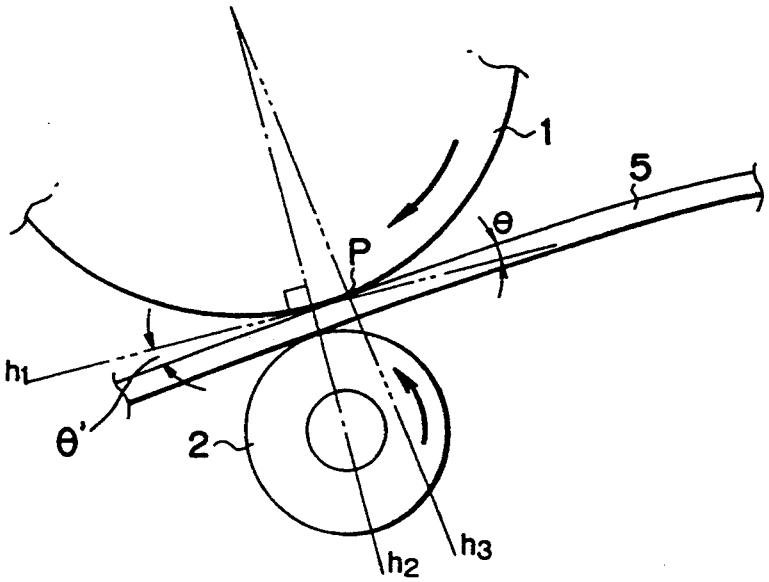
FIGS. 7A and 7B are enlarged views for explaining the attitude of the transfer material at the transfer station.
Figure 7B:
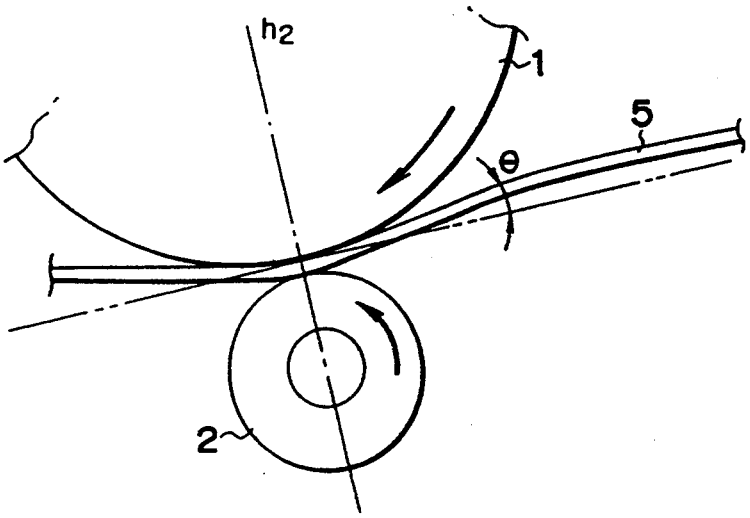

FIGS. 7A and 7B show an attitude of the transfer material at the transfer station in the illustrated embodiment. Particularly, FIG. 7A shows an attitude of the transfer material having the high rigidity, and FIG. 7B shows an attitude of the transfer material having the low rigidity. In FIG. 7A, $h_3$ shows a line connecting between a contact point P between the transfer material 5 and the photosensitive drum 1, and the center of the photosensitive drum 1, $h_2$ shows a line connecting between the centers of the photosensitive drum 1 and of the transfer roller 2 as in FIG. 5, and $h_1$ shows a line tangential to the photosensitive drum 1 at the transfer station and perpendicular to the line $h_2$ as in FIG. 5.

When the rigidity of the transfer material 5 is high, as shown in FIG. 7A, since the center line $h_2$ is positioned at a downstream side of the line $h_3$ passing through the contact point P and the transfer material 5 is closely contacted with the photosensitive drum 1 at the upstream side of the transfer station, the scattering of the image can be prevented.

When the rigidity of the transfer material 5 is low, as shown in FIG. 7B, the contact area between the transfer material 5 and the photosensitive drum 1 has a wider area than the case of FIG. 7A where the transfer material has the high rigidity. At the upstream side of 10 the transfer station, similar to FIG. 7A, the transfer material 5 is closely contacted with the photosensitive drum 1, thereby preventing the scattering of the image; whereas, at the downstream side of the transfer station, since the transfer material 5 is electrostatically attracted to the photosensitive drum 1 by the application of the transfer charge to shift the shifting path of the transfer material toward the photosensitive drum 1, the scattering of the image at the trailing end portion of the transfer material can be prevented more surely.

Second Embodiment

Figure 8:
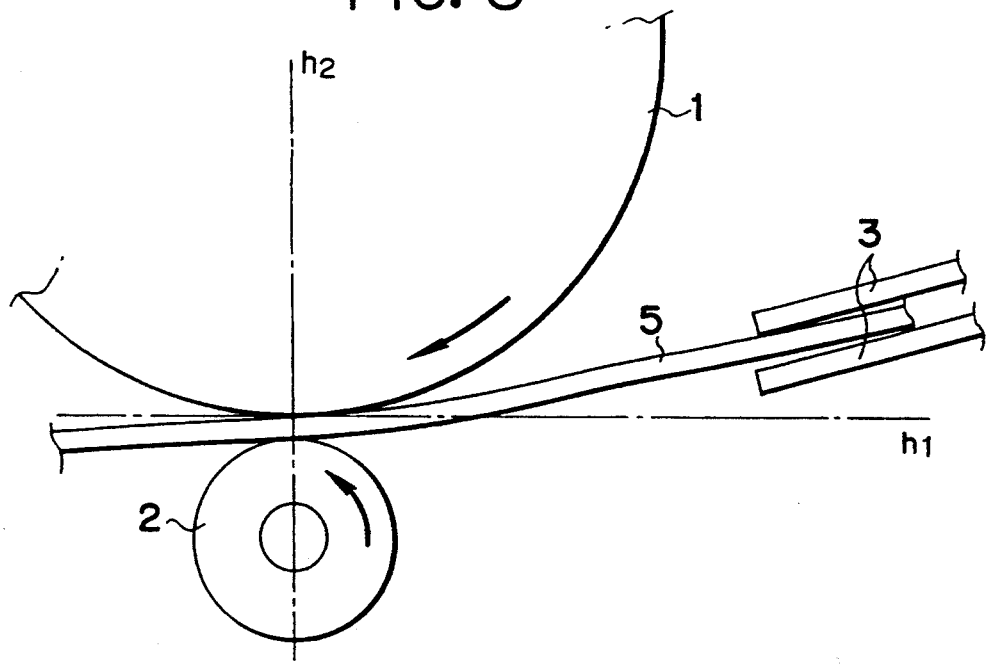
FIG. 8 is an enlarged view showing a transfer station and an upstream side thereof in an image forming apparatus according to another embodiment of the present invention.

FIG. 8 shows a transfer station and therearound in an image forming apparatus according to a second embodiment of the present invention. This second embodiment differs from the first embodiment in the point that the abut force of the rigidity of the transfer material has a minus value.

The following Table 2 shows the pressure force of the rigidity of the transfer material, pressure force of the transfer roller, and total pressure force resulting from the formed two pressure forces regarding various transfer materials.

TABLE 2

| Kind of transfer material | Pressure force of rigidity (g/cm) | Pressure force of transfer means (g/cm) | Total pressure force (g/cm) |
|---|---|---|---|
| 52 g/m$^2$ paper | −0.6 | 7.0 | 6.4 |
| 64 g/m$^2$ paper | −1.3 | 7.0 | 5.7 |
| OHP sheet | −2.3 | 7.0 | 4.7 |
| Post card | −5.5 | 7.0 | 1.5 |
| 128 g/m$^2$ paper | −3.3 | 7.0 | 3.7 |

In this embodiment, the total pressure force regarding the post card is smallest and the total abut force regarging the 52 g/m$^2$ paper is greatest. However, since all of the total pressure forces are below 8 g/cm, there was no problem of the void.

Third Embodiment

Figure 9:
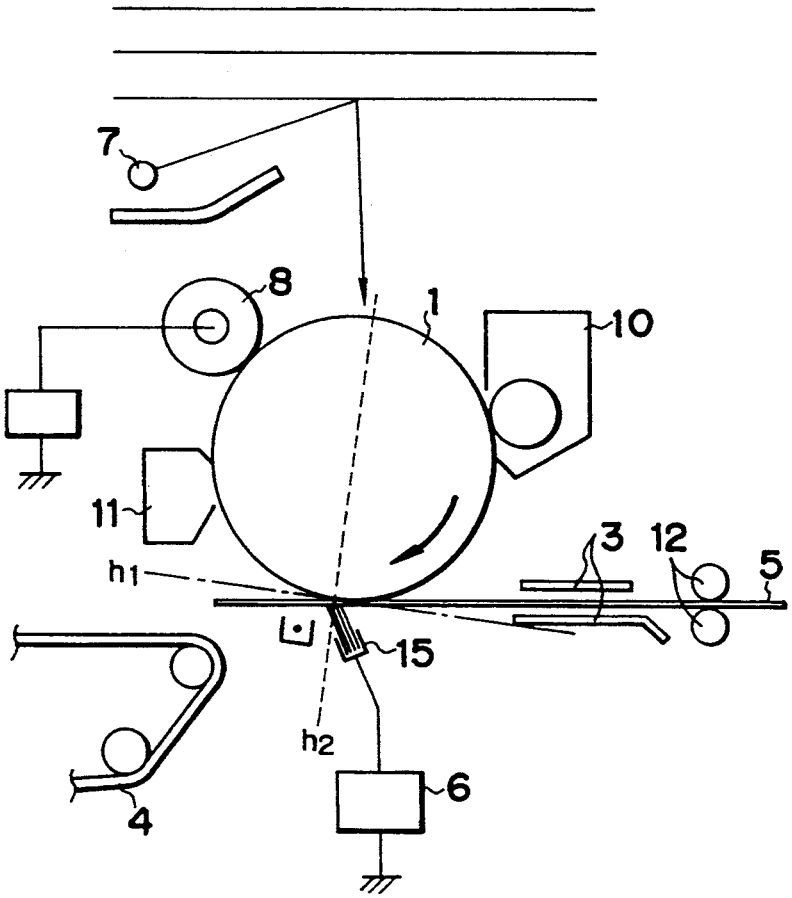
FIG. 9 is a schematic constructural view of an image forming apparatus according to a further embodiment of the present invention.

FIG. 9 is a schematic constructural view of an image forming apparatus according to a third embodiment of the present invention. This embodiment is characterized in that a transfer brush 15 comprising a conductive brush or a semi-conductive brush is used as the transfer means. Since the other features of this embodiment are substantially the same as those of the first embodiment, the same elements are designated by the same reference numerals.

The transfer brush 15 has the volume specific resistance of about $10^1$–$10^{11}$ Ω.cm and is made of resin such as nylon, polyester or the like including conductive filaments to provide the conductivity or is made of metal. A diameter of the transfer brush 15 is about 10–500 μm, and the mounting density of the brush fibers is about 10–1000 fibers/cm$^2$. The pressure force of the transfer brush 15 against the photosensitive drum 1 is about 0.5–5 g/cm. During the transferring operation, a voltage of about 500–5000 Volts (absolute value) is applied from the power source 6 to the transfer brush 15.

Also in this embodiment, since the total pressure force obtained by combining the pressure force of the rigidity of the transfer material and the pressure force of the transfer brush 15 is included within a range of 0.2–8 grams per 1 cm in the longitudinal direction, the void is not generated by the transfer brush, thus obtaining the good image.

Fourth Embodiment

Figure 10:
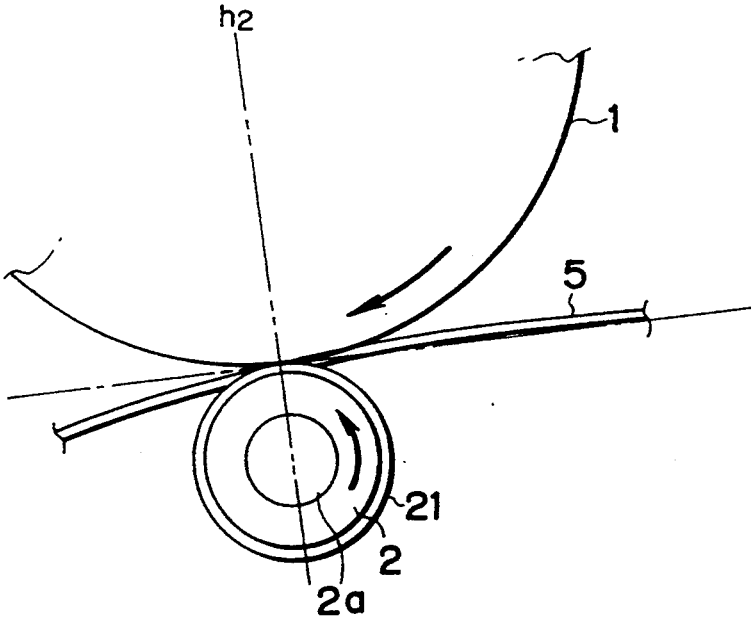
FIG. 10 is a view showing a transfer station in an image forming apparatus according to a still further embodiment of the present invention.
Figure 11:
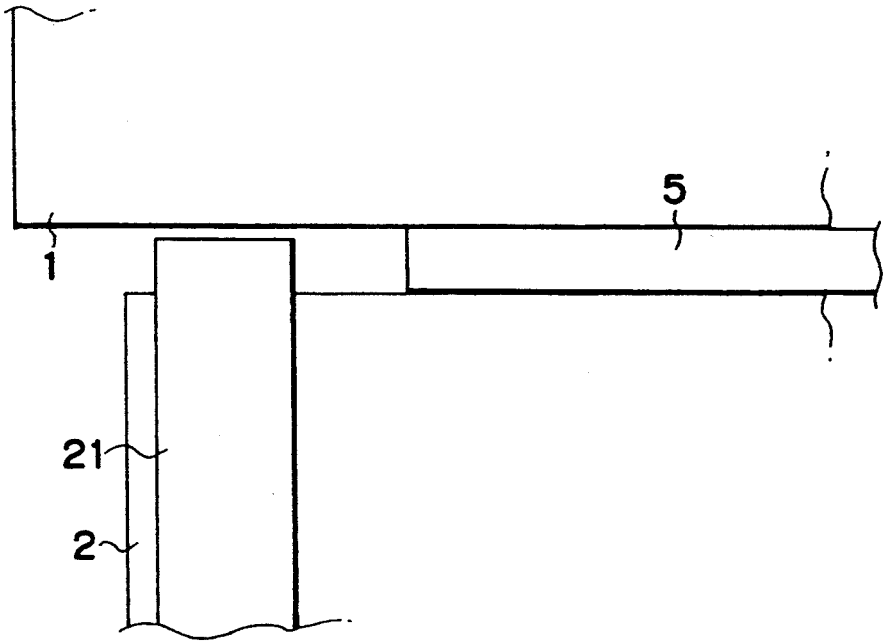
FIG. 11 is a transverse view of the transfer station of FIG. 10.

FIG. 10 shows a transfer station in an image forming apparatus according to a fourth embodiment of the present invention, and FIG. 11 is a transverse view of the transfer station. As shown in FIGS. 10 and 11, in this embodiment, ring-shaped spacers 21 are provided on an outer peripheral surface of the transfer roller at both end portions thereof. In this case, a thickness of each spacer 21 is about 20–200 μm. However, the thickness of the spacer 21 is not necessarily smaller than the minimum thickness of the available transfer material.

The transfer roller 2 is pressed against the photosensitive drum 1 toward the center of the photosensitive drum at the transfer station by biasing the transfer roller toward the photosensitive drum by a pressure spring (not shown). The transfer material 5 is sent to the transfer station from above a tangential line $h_1$ of the photosensitive drum 1 (at the side of the photosensitive drum 1), thereby contacting the transfer material with the photosensitive drum 1.

Also in this embodiment, by selecting the total pressure force obtained by combining the pressure force of the transfer roller 2 having the ring-shaped spacers 21 and the pressure force of the rigidity of the transfer material to be included within a range of 0.2–8 grams per 1 cm in the longitudinal direction of the transfer roller 2, the void cannot be generated by the transfer roller, thus obtaining the good image.

Fifth Embodiment

Figure 12:
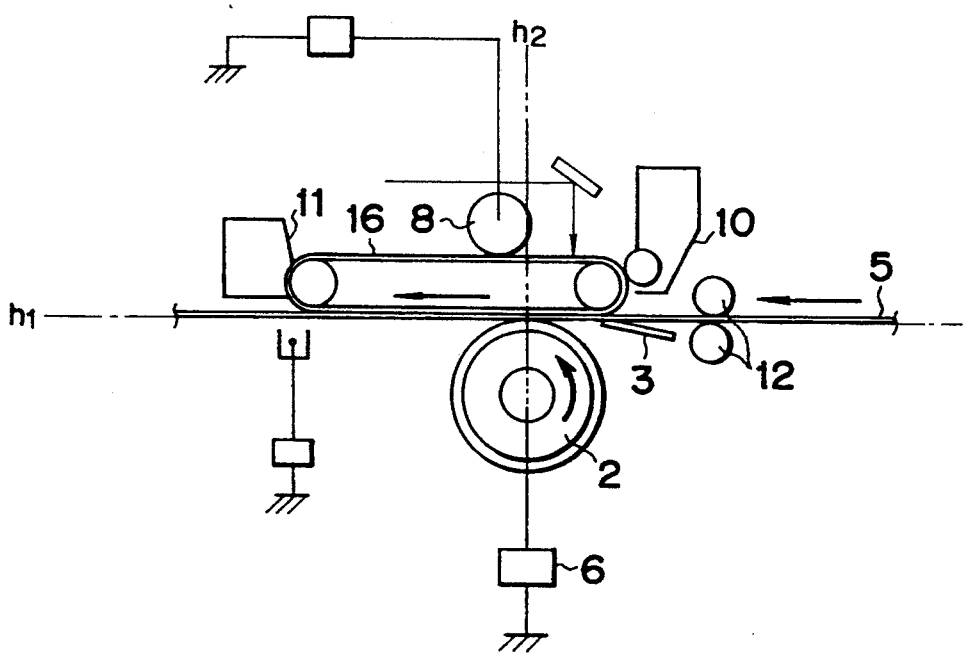
FIG. 12 is a schematic constructural view of an image forming apparatus according to a further embodiment of the present invention.

FIG. 12 is a schematic constructural view of an image forming apparatus according to a fifth embodiment of the present invention, in which is photosensitive belt 16 is used in place of the photosensitive drum 1. Since the other features of this embodiment are the same as those of the first embodiment, same elements (in FIG. 12) are designated by the same reference numerals (in FIG. 1).

The transfer roller 2 is pressed against the photosensitive belt 16 with an abut force of 0.1–5 g/cm in such a manner that the transfer roller is biased toward the photosensitive belt or a rotary shaft 2*a* of the transfer roller is fixed with respect to the photosensitive belt.

Also in this embodiment, by selecting the total pressure force obtained by combining the pressure force of the rigidity of the transfer material and the pressure force of the transfer roller 2 to be included within a range of 0.2–8 grams per 1 cm in the longitudinal direction of the transfer roller 2, the void cannot be generated by the transfer roller 2, thus obtaining the good image.

Sixth Embodiment

Figure 13:
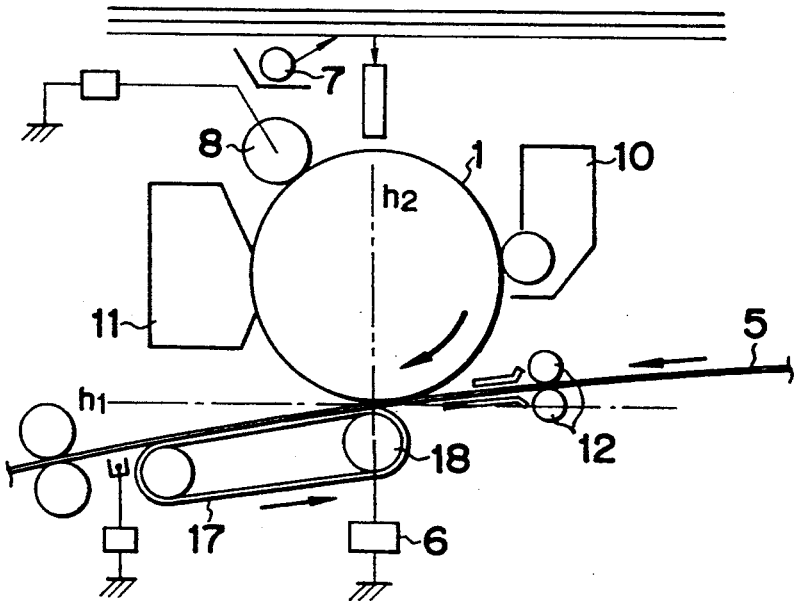
FIG. 13 is a schematic constructural view of an image forming apparatus according to a still further embodiment of the present invention.

FIG. 13 is a schematic constructural view of an image forming apparatus according to a sixth embodiment of the present invention, in which a transfer belt 17 is used in place of the transfer roller. Since the other features of this embodiment are the same as those of the first embodiment, same elements (in FIG. 13) are designated by the same reference numerals (in FIG. 1).

The transfer belt 17 is wound around and extends between a pair of rollers. One of these rollers is a conductive roller 18 which forms a part of the transfer means. The conductive roller 18 is pressed against the photosensitive drum 1 with the interposition of the transfer belt 17.

Also in this embodiment, by selecting the total pressure force obtained by combining the pressure force of the conductive roller 18 and the pressure force of the rigidity of the transfer material to be included within a range of 0.2–8 grams per 1 cm in the longitudinal direction of the conductive roller 18, the void cannot be generated by the conductive roller 18, thus obtaining the good image.

As mentioned above, according to the present invention, since the total pressure force (i.e., maximum pressure force) obtained by combining the pressure force of the transfer material pressed against the image bearing member by the transfer means of contact type such as the transfer roller and the pressure force of the rigidity of the transfer material itself during the transferring operation is weak so as to become 0.2–8 grams per 1 cm in the longitudinal direction of the transfer means, it is possible to obtain the good image without any void due to the transfer means and to prevent the fusion of the toner to the image bearing member and the filming.

The present invention is not limited to the illustrated embodiments, but various alterations and modifications can be adopted within the scope of the present invention.

What is claimed is:

1. An image forming apparatus, comprising:

an image bearing member;

image forming means for forming a toner image on said image bearing member; and transfer means for transferring in a transfer operation the toner image onto a transfer material at a transfer station, said transfer means capable of contacting a surface of the transfer material opposite to said image bearing member;

wherein a combined force of a pressure force of the transfer material onto said image bearing member and a pressure force of said transfer means onto said image bearing member is selected to be 0.2–8 grams per 1 cm in a longitudinal direction of said transfer means regardless of the transfer material used during the transfer operation.

2. An image forming apparatus according to claim 1, wherein said transfer means is capable of contacting with said image bearing member.

3. An image forming apparatus according to claim 1, wherein a voltage having a polarity opposite to a charge polarity of said toner image is applied to said transfer means during the transferring operation.

4. An image forming apparatus according to claim 1, further comprising guide means for guiding the transfer material to said transfer station, said guide means guiding the transfer material situated at an upstream side of said transfer station in a conveying direction of said transfer material in such a manner that said transfer material is guided near said image bearing member with respect to a tangential line tangential to said image bearing member at said transfer station.

5. An image forming apparatus according to claim 1, further comprising guide means for guiding the transfer material to said transfer station, said guide means guiding the transfer material situated at an upstream side of said transfer station in a conveying direction of said transfer material in such a manner that said transfer material is guided near said image bearing member with respect to a tangential line tangential to said image bearing member at said transfer station and perpendicular to a line connected between rotary centers of said image bearing member and of said transfer means.

6. An image forming apparatus according to claim 4, wherein the transfer material is guided near said image bearing member with respect to said tangential line at a downstream side of said transfer station in the conveying direction of said transfer material.

7. An image forming apparatus according to claim 5, wherein the transfer material is guided near said image bearing member with respect to said tangential line at a downstream side of said transfer station in the conveying direction of said transfer material.

8. An image forming apparatus according to claim 1, wherein said transfer means comprises a rotary member.

9. An image forming apparatus according to claim 2, wherein said transfer means comprises a rotary member.

10. An image forming apparatus according to claim 1, wherein said transfer means has a brush-shape.

11. An image forming apparatus according to claim 2, wherein said transfer means has a brush-shape.

12. An image forming apparatus according to claim 1, wherein a hardness of said transfer means is 20–40° in ASKER-C hardness.

13. An image forming apparatus according to claim 1, wherein said transfer means includes an elastic layer.

14. An image forming apparatus according to claim 1, wherein a speed of said transfer means differs at said transfer station from a speed of said image bearing member at said transfer station.

15. An image forming apparatus according to claim 1, wherein a post card can be used as the transfer material.

* * * * *

UNITED STATES PATENT AND TRADEMARK OFFICE

CERTIFICATE OF CORRECTION

PATENT NO. : 5,406,360
DATED : April 11, 1995
INVENTOR(S) : JUN ASAI

It is certified that error appears in the above-indentified patent and that said Letters Patent is hereby corrected as shown below:

Column 2,
line 42, "constructural" should be deleted".
Column 6,
line 32, "abut" should read --pressure--.
Column 8,
line 55, "constructural" should be deleted.
Column 9,
line 44, "constructural" should be deleted; and
line 65, "constructural" should be deleted.

Signed and Sealed this

Eleventh Day of July, 1995

*Attest:*

Bruce Lehman

BRUCE LEHMAN

*Attesting Officer*

*Commissioner of Patents and Trademarks*